US010287721B1

(12) United States Patent
Rizzo

(10) Patent No.: US 10,287,721 B1
(45) Date of Patent: May 14, 2019

(54) GARMENT SHAPING DEVICE

(71) Applicant: Elizabeth Rizzo, Dunnellon, FL (US)

(72) Inventor: Elizabeth Rizzo, Dunnellon, FL (US)

( * ) Notice: Subject to any disclaimer, the term of this patent is extended or adjusted under 35 U.S.C. 154(b) by 32 days.

(21) Appl. No.: 15/631,014

(22) Filed: Jun. 23, 2017

(51) Int. Cl.

| | |
|---|---|
| ***D06C 23/00*** | (2006.01) |
| ***A41F 1/00*** | (2006.01) |
| ***A44C 1/00*** | (2006.01) |
| ***A41D 27/08*** | (2006.01) |

(52) U.S. Cl.
CPC ..... *D06C 23/00* (2013.01); *A41D 27/08* (2013.01); *A41F 1/00* (2013.01); *A44C 1/00* (2013.01); *Y10T 24/155* (2015.01)

(58) Field of Classification Search
CPC ... D06C 23/00; Y10T 24/155; B65D 33/1625; B65D 33/24; B65D 77/10; A41F 1/00; A41F 1/04; A44C 1/00; G09F 3/06; A41D 23/00; A41D 27/08
USPC ..... D32/61; D6/546; 24/DIG. 29, 130, 72.5, 24/114.4, 114.12; 2/113, 244, 217, 271
See application file for complete search history.

(56) References Cited

U.S. PATENT DOCUMENTS 686,690 A * 11/1901 Fishel
1,452,052 A * 4/1923 Nalle ..... A44B 1/34 24/114.4
3,170,213 A * 2/1965 Thomas, Jr. ..... A41F 1/00 24/30.5 S
3,346,927 A * 10/1967 Tompkins ..... A47K 10/12 24/464
5,005,218 A 4/1991 Ganz
5,156,023 A * 10/1992 Bevolo ..... A44C 1/00 24/103
5,511,289 A * 4/1996 Melia ..... A44B 6/00 24/459
6,161,263 A * 12/2000 Anderson ..... A41B 11/002 24/30.5 S
D445,980 S * 7/2001 Tjugum ..... D32/61
8,230,557 B2 * 7/2012 McNeil ..... A44B 6/00 2/144
8,347,416 B1 * 1/2013 Query ..... A41F 1/00 2/244
9,489,873 B2 * 11/2016 Sinclair ..... A44C 1/00
2010/0043125 A1 * 2/2010 MacLean ..... A41F 1/00 2/336

FOREIGN PATENT DOCUMENTS

DE 202012101511 U1 * 7/2012

* cited by examiner

*Primary Examiner* — Ismael Izaguirre
(74) *Attorney, Agent, or Firm* — Terry M. Sanks, Esq.; Beusse Wolter Sanks & Maire, PLLC

(57) ABSTRACT

Disclosed is a two part device for the use of shaping and styling garments such as t-shirts. The bottom device is a solid plastic unit which is rigid on the outside edge and gets thinner towards the inside of the unit forming the plurality of members which, because of the thinness of the plastic, the members become flexible. The inner plurality of integrally formed flexible inner members are spaced apart with an opening that allows the garment fabric to be pulled through and held securely in place. The top device, a solid unit made of elastomeric plastic, fits over top of the bottom device and snaps in place to hide the garment fabric and add style to the garment. The top device is not needed to hold the garment fabric in place but rather is used as a decorative unit to add style to the garment.

19 Claims, 2 Drawing Sheets

Figure 1:
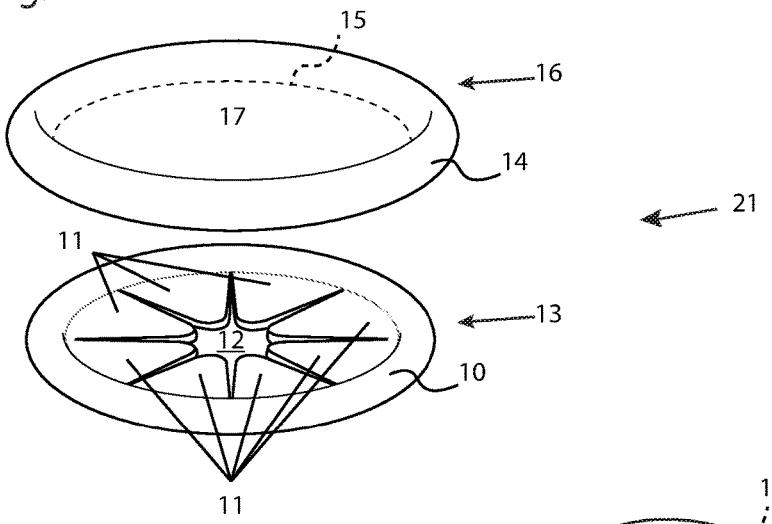

Fig. 4
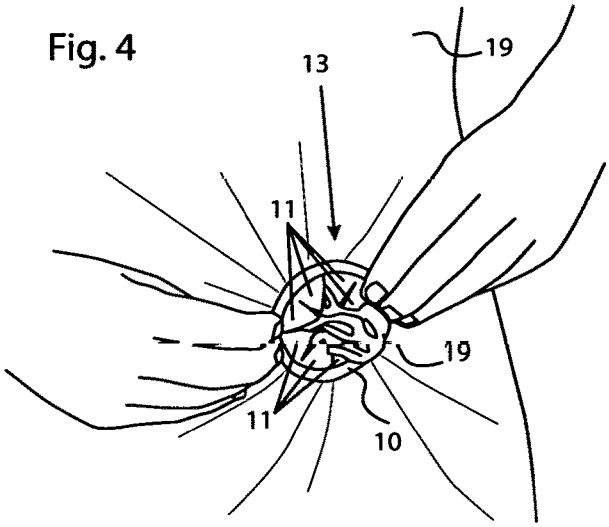
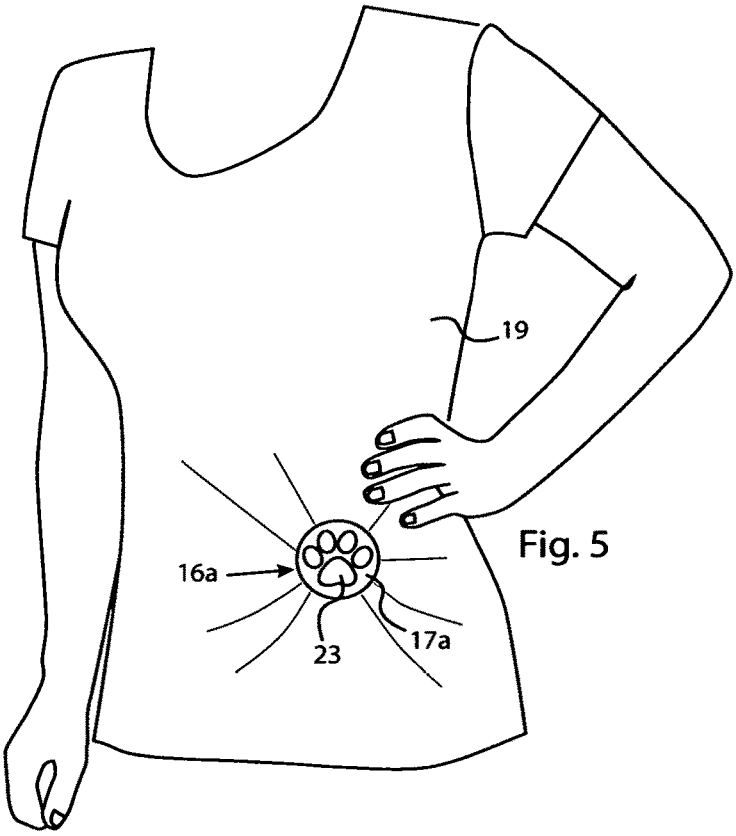
Fig. 5

GARMENT SHAPING DEVICE

RELATED APPLICATIONS

The present patent application claims priority to U.S. Provisional Patent Application Ser. No. 62/354,757 filed Jun. 26, 2016, the entire contents of which are herein incorporated by reference.

BACKGROUND OF THE INVENTION

1. Field of the Invention

The present invention relates to a device for the use of gripping the fabric of a garment. More particularly the invention relates to a device for the use of gripping the fabric of a garment which will alter the shape and stylize the garment.

Garments, such as t-shirts and the like are often loose fitting and plain. It is desirable and fashionable to have a way to transform a loose fitting and plain garment such as a t-shirt, into a form fitting garment which will accent the shape of the wearer and have a way to add style to the garment.

Traditionally, in attempts to accomplish this, garment fabrics have been cut at the hem of the shirt and tied in a knot to tighten the looseness of the garment, such as a t-shirt but this requires the garment fabric to be cut which damages the garment or another way to accomplish this is the use of rubber bands which have been used to hold gathered fabric of a garment, such as a t-shirt, and it would generally hold a section of fabric at the hem in an attempt to tighten the looseness of the garment but rubber bands are exposed and are unattractive.

Another attempt is to use a device to tighten the garment at the tail or hem of the shirt but this is limited to a specific area.

Description of Related Art

U.S. Pat. No. 5,005,218 discloses an aperture in the body of a garment of which a piece of cut garment is pulled through in order to cinch the waist of a garment.

The present invention addresses the problem of damaging a garment by providing a removable device to alter and shape the garment which will not harm the garment.

U.S. Pat. No. 5,511,289 discloses a buckle for use with t-shirts whereas the tail or hem is inserted through the device to add shape and style.

The present invention addresses the problem of being limited to shaping just the tail or hem of a garment. The present invention can be placed in several places on a garment to reach a desired effect of shaping.

BRIEF SUMMARY OF THE INVENTION

The present invention enables the garment wearer the ability to alter and shape the garment with the use of a rigid base device that has a plurality of integrally formed flexible inner members and a space of which the garment fabric can be pulled through whereas the inner members will grip the fabric to hold it in place. Once the base device is in place on the garment, a cover device can be placed over top of the base device and snapped on with the lip of the cover device holding it in place securely. The cover device hides the fabric pulled through the base device. The cover device can be made in different colors and can be decorated and embellished to suit the wearer. The cover device is not needed to hold the garment fabric in place but rather is for finishing the look and style of the garment shaping device. There is no limit as to where the garment shaping device can be placed to alter and shape a garment.

BRIEF DESCRIPTION OF THE INVENTION

FIGS. 1*a* and 1*b* is an exploded view of a garment shaping device constructed according to a first preferred embodiment of the present invention.

FIGS. 2*a* and 2*b* is an exploded view of a garment shaping device constructed according to a different shape of the embodiment of the present invention.

Figure 3:
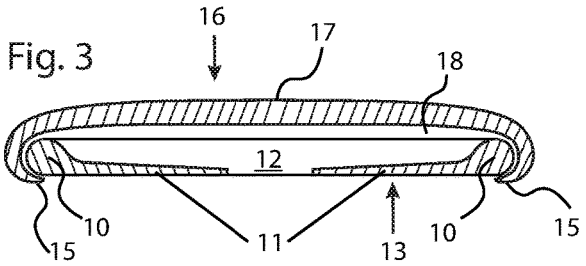

FIG. 3. is a cross section view of a garment shaping device in accordance with the present invention.

FIG. 4. is a front elevation showing the base of the garment shaping device attached to a t-shirt.

FIG. 5. illustrates the garment shaping device with a t-shirt.

DETAILED DESCRIPTION OF THE INVENTION

Before any embodiments of the invention are explained in detail, it is to be understood that the invention is not limited in its application to the details of constriction and the arrangement of components set forth in the following description or illustrated in the accompanying drawings. The invention is capable of other embodiments and of being practiced or of being carried out in various ways. The drawings of the present invention demonstrate some of the ways the garment shaping device can be customized.

Figure 2:
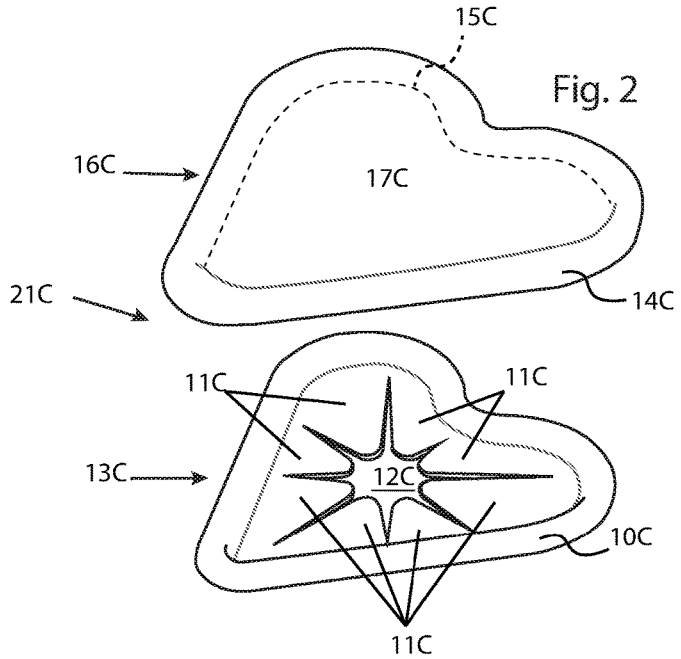

FIGS. 1 and 2 show detailed exploded views of the garment shaping device 21 and 21*c*, FIG. 1 being of one shape and FIG. 2 being of a different shape but both identical in function. Referring to FIGS. 1 and 2, the base device 13 and 13*c* is a solid plastic unit showing a shape of thicker and more rigid plastic around the perimeter 10 and 10*c* and plastic in the interior becoming thinner as they continue toward the center forming a plurality of members 11 and 11*c* which stop short to define an opening 12 and 12*c* whereas the garment fabric 19 of FIG. 4 is pulled through. The flexibility of the members 11 and 11*c* grip the garment fabric 19 of FIG. 4 and is held securely in place. The cover device 16 and 16*c*, made of an elastomeric material, is molded to fit the shape of the base device 13 and 13*c*. The perimeter 14 and 14*c* of the cover device 16 and 16*c* has a lip 15 and 15*c* which is curved enough fit the perimeter 10 and 10*c* of the base device 13 and 13*c* to hold it securely in place. The top surface 17 and 17*c* of the cover device 16 and 16*c* can be decorated.

FIG. 3 shows a detailed cross section view of the garment shaping device 21 where the cover device 16 is securely attached to the base device 13, which leaves an air space 15 that allows the garment fabric 19 to be stored.

FIG. 4 shows the members 11 of the base device 13 holding the garment fabric 19 in place. Wrinkles are formed in the garment fabric as the garment 19 gets tighter when it is pulled through the opening 12 of the base device 13 which allows the wearer to achieve a shaping effect.

FIG. 5 shows an embodiment of a garment shaping device which permits the wearer to custom fit common tee shirts or other garments 19 by making them shape closer to the body.

The cover device 16 may be customized in the manufacturing process to give different shapes of the garment shaping device 21 and 21*c* of FIGS. 1 and 2 and different designs 23 such as a paw print, a heart shape, awareness ribbons and other popular designs, built into the top surface 17*b* of the material.

The garment shaping device 21 includes a removable base receiving structure (i.e., base device 13) having an interior surface defining an opening 12, the opening including a center. The garment shaping device 21 includes a plurality of resilient members 11 integrally formed with the removable base receiving structure (i.e., base device 13) and extending from the interior surface toward the center of the opening 12 so that a portion of the garment 19 pulled through the opening 12 is secured therein by the resilient members 11 to cinch the garment around the individual wearing the garment. The garment shaping device 10 includes a cover (i.e., cover device 16) removably attachable to the base device 13 to conceal the garment fabric 19 which is pulled through the opening 12 of the removable base receiving structure.

The removable base receiving structure (i.e., base device 13) is in the shape of a ring wherein the ring has a thickness. The resilient members 11 have a thickness less than the thickness of the ring, so that the base receiving structure (i.e., base device 13) is rigid, and the resilient members 11 are generally flexible relative to the base receiving structure (i.e., base device 13).

The structure of the cover device 16 is a solid structure shaped to fit securely over the removable base receiving structure (i.e., base device 13) with a perimeter lip on the underside of the cover device 16 enclosing securely the outer perimeter of the removable base receiving structure (i.e., base device 13).

What is claimed is:

1. A garment shaping device comprising:

a removable base device having an outside perimeter and an interior surface defining an opening, the opening including a center, the outside perimeter being thicker than the interior surface;

a plurality of resilient members integrally formed with the base device and extending from the interior surface toward the center of the opening so that a portion of fabric of a garment selectively placed behind the removable base device pulled through the opening is secured therein by the plurality of resilient members to cinch the fabric around an individual wearing the garment; and a cover device comprising a top surface having a lip forming a curved perimeter attachable to the outside perimeter of the base device to conceal the cinched fabric pulled through the opening of the base device wherein the curved perimeter of the top surface securely fits over and under the outside perimeter of the base device.

2. The garment shaping device as set forth in claim 1, wherein the base device is in a shape of a ring structure defining the opening, wherein the ring structure has a perimeter thickness and the plurality of resilient members has a thickness less than the perimeter thickness so that the ring structure is rigid, and the plurality of resilient members is flexible relative to the ring structure.

3. The garment shaping device as set forth in claim 1, wherein the cover device is a solid structure shaped to fit securely over and under the base device with a perimeter lip on an underside of the cover device enclosing securely the outer perimeter of the base device.

4. The garment shaping device as set forth in claim 1, wherein the resilient members are spaced from one another around the opening.

5. The garment shaping device as set forth in claim 1, wherein the base device is formed from rigid plastic at the perimeter which is thicker than the interior surface of the base device wherein the interior surface tapers toward the center and along the resilient member so that the resilient members are flexible.

6. The garment shaping device as set forth in claim 5, wherein the cover device is formed from an elastomeric material.

7. A garment shaping device comprising:

a removable base device having an outside perimeter and an interior surface defining an opening, the opening including a center, the outside perimeter being thicker than the interior surface wherein the interior surface tapers in thickness toward the center;

a plurality of resilient members integrally formed with the base device and extending from the interior surface toward the center of the opening so that a portion of fabric of a garment, selectively placed behind the base device and pulled through the opening, is secured in the opening by the plurality of resilient members to cinch the fabric around an individual wearing the garment for a shaping effect; and a cover device comprising a top surface having a curved perimeter which fits over and under and encloses the outside perimeter of the base device to conceal the cinched fabric pulled through the opening of the base device.

8. The garment shaping device as set forth in claim 7, wherein:

the base device has a ring shape, wherein the ring shape has a rounded perimeter edge; and the plurality of resilient members has a thickness less than the thickness of the outside perimeter and tapers in thickness toward the center, so that the outside perimeter of the base device is rigid, and the plurality of resilient members being flexible relative to the outside perimeter of the base device.

9. The garment shaping device as set forth in claim 8, wherein the curved perimeter of the cover device comprises a curved lip configured to receive and fit over and under the rounded perimeter edge of the base device.

10. The garment shaping device as set forth in claim 9, wherein the cover device is formed from an elastomeric material.

11. The garment shaping device as set forth in claim 10, wherein the cover device is configured to snap in place enclosing the outside perimeter of the base device.

12. The garment shaping device as set forth in claim 7, wherein the plurality of resilient members is spaced from one another around the opening.

13. The garment shaping device as set forth in claim 7, wherein an air space is formed between an underside of the top surface of the cover device attached to the base device and the interior surface of the base device.

14. The garment shaping device as set forth in claim 7, wherein the cover device is removably attachable to the base device and separate from the base device.

15. The garment shaping device as set forth in claim 7, wherein the cover device when removed from the base device is unconnected from the base device.

16. A garment shaping device comprising:

a removable base device having an outside perimeter and an interior surface defining an opening, the opening including a center, the outside perimeter being thicker than the interior surface wherein the interior surface tapers in thickness toward the center;

a plurality of resilient members integrally formed with the base device and extending from the interior surface toward the center of the opening so that a portion of fabric of a garment, selectively placed behind the base device and pulled through the opening, is secured in the opening by the plurality of resilient members to cinch the fabric around an individual wearing the garment for a shaping effect; and a cover device removably and selectively attachable to the base device, the cover device comprising a top surface having a curved perimeter being curved inward toward an underside of the top surface and which fits over and under and encloses the outside perimeter of the base device to conceal the cinched fabric pulled through the opening of the base device.

17. The garment shaping device as set forth in claim 16, wherein:

the base device has a ring shape, wherein the ring shape has a rounded perimeter edge;

the plurality of resilient members has a thickness less than the thickness of the outside perimeter and tapers in thickness toward the center, so that the outside perimeter of the base device is rigid, and the plurality of resilient members being flexible relative to the outside perimeter of the base device; and an underside of the interior surface of the base device and an underside of the plurality of resilient members are flat.

18. The garment shaping device as set forth in claim 16, wherein the curved perimeter of the cover device comprises a curved lip configured to receive and fit over and under the rounded perimeter edge of the base device.

19. The garment shaping device as set forth in claim 16, wherein the cover device when removed from the base device is unconnected from the base device.

* * * * *